United States Patent [19]

Kommrusch

[11] 3,981,017

[45] Sept. 14, 1976

[54] CENTER FED VERTICAL GAIN ANTENNA

[75] Inventor: Richard Stephen Kommrusch, Hoffman Estates, Ill.

[73] Assignee: Motorola, Inc., Schaumburg, Ill.

[22] Filed: Mar. 31, 1975

[21] Appl. No.: 563,536

[52] U.S. Cl. ..... 343/792; 343/802; 343/828

[51] Int. Cl.[2] ..... H01Q 9/16

[58] Field of Search ..... 343/790, 791, 792, 802, 343/828, 885

[56] References Cited

UNITED STATES PATENTS

| | | | |
|---|---|---|---|
| 2,201,857 | 5/1940 | Dome | 343/790 |
| 2,486,597 | 11/1949 | Greene | 343/792 |
| 2,750,589 | 6/1956 | Harris | 343/791 |
| 3,490,025 | 1/1970 | Pickles | 343/885 |

*Primary Examiner*—Eli Lieberman
*Attorney, Agent, or Firm*—Phillip Melamed; James W. Gillman; Victor Myer

[57] ABSTRACT

An improved gain antenna which is vertically mounted to a horizontal ground plane is disclosed. The gain antenna substantially consists of a radiating conductor having first and second ends and a centrally located feed point, and phasing apparatus electrically connected to the conductor for producing a predetermined current distribution. The phasing apparatus produce shortened out of phase current sections along the length of the conductor. Centrally feeding the gain antenna results in an improvement in the bandwidth and input impedance. The conductor consists of a linear section of coaxial cable which extends vertically from the horizontal ground plane to approximately the central feed point and a solid conductor rod which extends vertically upwardly from the central feed point. Current phasing apparatus having improved bandwidth and reactance characteristics are also described. The phasing apparatus consist of pairs of metallic cylinders which are concentrically positioned around the conductor with each cylinder having one end electrically connected to the conductor.

17 Claims, 6 Drawing Figures

CENTER FED VERTICAL GAIN ANTENNA

BACKGROUND OF THE INVENTION

The invention relates generally to the field of directive gain antennas whereby the strength of the radiated electromagnetic field is concentrated in certain specified directions. In particular, the invention relates to vertically aligned gain antennas which are used in conjunction with a substantially horizontal ground plane and which use phasing apparatus to produce a predetermined current distribution along the antenna. Such gain antennas are generally well known and are end fed (excited) by a transmitter which supplies an RF signal to be radiated. Of course in receiver applications, the antenna end feed point is connected to a receiver and the antenna receives electromagnetic signals from the radiation pattern present in the transmitting medium.

The vertical antenna produces gain in a specified direction by arranging the current distribution along the radiating surface of the antenna such that inphase currents along the antenna will add and reinforce the radiation pattern in a given direction. The effect of out of phase currents is minimized by reducing their effective path length along the antenna. The out of phase current paths are shortened in length by phasing apparatus which effectively couple an inductance in series with the antenna at predetermined locations along its length. The gain of the antenna is related to the combined path length of all the inphase currents along the antenna.

In standard end fed antennas, the number of inphase current sections can be increased to produce more antenna gain by increasing the physical length of the antenna. However, the bandwidth of such a lengthened antenna is decreased because bandwidth varies inversely with the actual physical length that the radiating current effectively travels along the antenna, as measured in terms of electrical wavelengths. Thus in prior vertical gain antennas, the actual physical length of the antenna limits not only the actual antenna gain obtainable but also the bandwidth. For an antenna which requires a wide bandwidth, only a small amount of gain is practically realizable by prior gain antennas. The end feeding of gain antennas also results in input impedances which require complex broadband matching networks to provide a suitable impedance match between the antenna and the transmitter.

In one type of gain antenna phasing apparatus, a single metallic cylinder shorted at one end is used to produce an effective inductance at a point along a conductor, but such an inductance has an inherently narrow bandwidth. In another type of phasing apparatus, a reactance coil is placed in series with the radiating element, but this weakens the resultant antenna structure. In still another type, effective inductances are produced by reducing the diameter of the radiating surface so as to form pairs of sleeves. This structure limits the amount of inductance obtainable, results in a weak mechanical structure, and is difficult to initially manufacture and adapt for different placement along the radiating surfaces of similar antennas having different operating frequencies or different current distributions.

SUMMARY OF THE INVENTION

An object of this invention is to provide an improved gain antenna for overcoming the aforementioned deficiencies.

Another object of this invention is to provide an improved gain antenna having a wide bandwidth and good mechanical strength.

Still another object of this invention is to provide an improved center fed gain antenna having an input impedance which can be easily matched.

A further object of this invention is to provide an improved phasing apparatus having a wide bandwidth and resulting in a strong mechanical structure when used with an antenna.

A still further object of this invention is to provide an improved phasing apparatus having a wide bandwidth which is easy to initially manufacture and adapt for differing placements along a radiating surface, and which is not limited in the amount of reactance realizable.

In an embodiment of the present invention, an improved gain antenna for use with a ground plane at predetermined frequencies is provided and comprises: conductor means having a predetermined length for radiating an electrical signal therealong, the conductor means having first and second ends spaced apart and a feed point located substantially centrally thereof, the first end being adapted to be positioned adjacent to and electrically coupled to the ground plane, the second end being adapted to be positioned substantially away from the ground plane, and phasing means connected to the conductor means for producing therealong a predetermined current distribution having a shortened out of phase section.

The present invention illustrates a vertical gain antenna which consists of a substantially linear center fed conductor for radiating electrical signals. The conductor is perpendicular to a horizontal ground plane and has one end electrically and mechanically connected thereto and another end located away therefrom. Phasing apparatus are connected to the conductor for producing a predetermined current distribution along the conductor having shortened out of phase sections. By electrically and mechanically attaching one end of the conductor to ground, good mechanical stability of the antenna is obtained. By center feeding the inventive antenna, a wide bandwidth antenna having an improved input impedance is obtained. The improvement in the bandwidth results from shortening the physical and electrical distance that the radiating antenna currents will effectively travel, because bandwidth is inversely related to this distance.

Pairs of metallic cylindrical sleeves are used to produce effective wide bandwidth inductances in series with the radiating conductor of the gain antenna. The metallic cylinders each have a diameter larger than the radiating conductor and are concentrically positioned thereabout. The members of each pair of cylinders are positioned with both having an open end facing and adjacent each other and with their other ends closed and electrically connected to the radiating conductor. Each cylinder of each phasing pair contributes a series inductance to the radiating antenna section at its open end and provides a wide bandwidth inductance since the physical length of each element contributing to the total inductance is reduced. The metallic sleeve pairs can easily be positioned anywhere along a radiating conductor and do not substantially weaken the resultant antenna structure.

BRIEF DESCRIPTION OF THE DRAWINGS

For a more complete understanding of the invention reference should be made to the drawings in which.

DESCRIPTION OF THE PREFERRED EMBODIMENT OF THE INVENTION

Figure 1A:
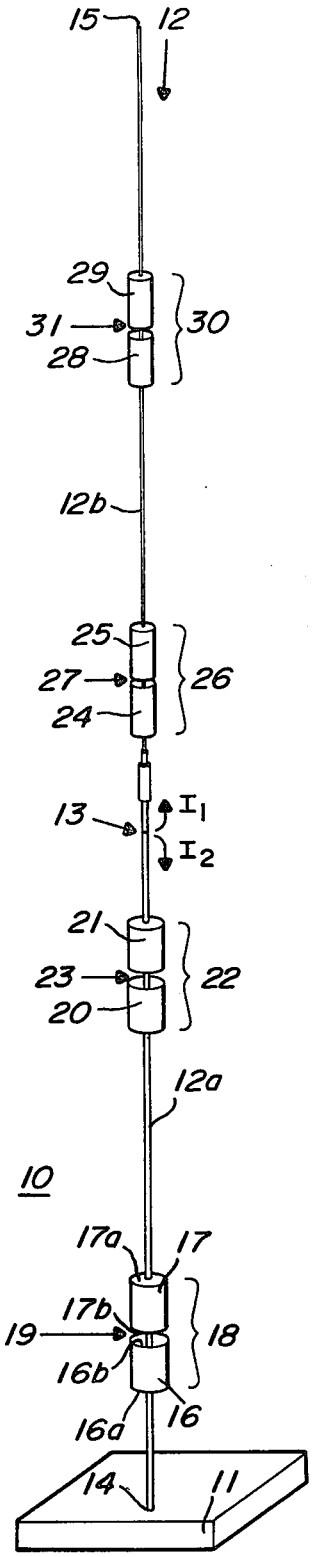
FIG. 1A is a perspective view of an improved gain antenna constructed according to the invention.

Referring to FIG. 1A, an 8db 900Mhz mobile gain antenna 10 is shown extending approximately 39 inches above a horizontal ground plane 11, which would preferably be the roof or trunk of a car.

The antenna consists of substantially a single conductor radiating element generally referred to as 12 which is fed from a centrally located point generally designated as 13. The conductor 12 has a first end 14 electrically and mechanically connected to ground plane 11 and extends vertically upward from the ground plane to the central feed point 13 thereby forming a first conductor portion 12*a*. A second portion 12*b* extends from the central feed point 13 upwardly and perpendicularly to ground plane 11 to a second end point 15 of conductor 12. The first and second conductor portions 12*a* and 12*b* are substantially colinear and determine the physical length of the inventive antenna.

A metallic cylinder 16, having a diameter larger than conductor 12*a*, is shown concentrically disposed thereabout and has a closed end 16*a* connected thereto and an open end 16*b* facing away from the ground plane 11. A similar metallic cylinder 17 is concentrically disposed around conductor 12*a* and has a closed end 17*a* electrically and mechanically connected to conductor 12*a* and an open end 17*b* positioned facing and adjacent to the open end 16*b* of cylinder 16.

Metallic cylinders 16 and 17 comprise a phasing apparatus generally referred to as 18. The adjacent open ends 16*b* and 17*b* are separated by a gap generally referred to as 19 which is located approximately one fourth of the distance upward along conductor 12*a* between ground plane 11 and central feed point 13.

The physical distance between the open and closed ends of cylinder 16 is substantially less than a quarter of a wavelength at the operating frequency. Cylinder 17 is similarly dimensioned. Phasing apparatus 18 produces an effective series inductive reactance at gap 19 for shortening the effective path of the current distribution thereabout. For optimum performance, the distance between the closed ends of the cylinders is less than a half wavelength and should be approximately equal to the effective shortened half wavenlength of the out of phase current that exists on the antenna at gap 19.

Cylinders 20 and 21 form an identical phasing apparatus 22 disposed around a gap 23 which is located roughly three quarters of the distance upward between the ground plane 11 and the central feed point 13. Cylinder 21 is located closer to the feed point 13 than cylinder 18. The cylinders 24 and 25 form a phasing apparatus 26 around a gap 27 which is located on conductor 12*b* roughly one fifth of the distance between the feed point 13 and the end 15 of conductor portion 12*b*. Cylinder 24 is located closer to feed point 13 than cylinder 25. The cylinders 28 and 29 form a similar phasing apparatus 30 about a gap 31 which is located along conductor 12*b* roughly three fifths of the distance upward between feed point 13 and the end 15 of conductor 12*b*. Cylinder 28 is positioned closer to the feed point 13 than cylinder 29. The gaps between the phasing cylinders should normally be greater than an eighth of an inch so that the effect of stray coupling between the cylinders is minimized.

Figure 1B:
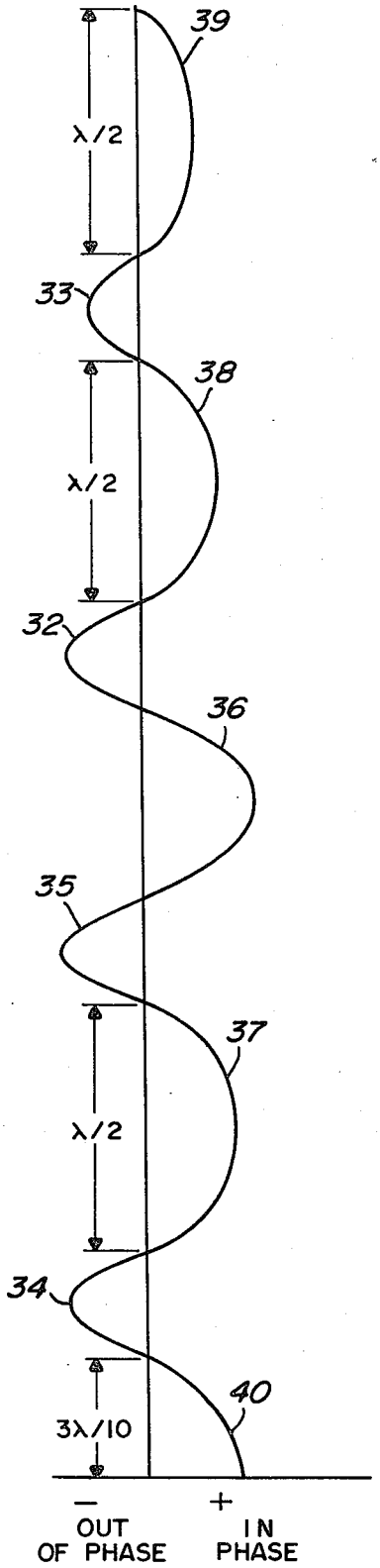
FIG. 1B is a diagram of the current distribution along the antenna.

The associated effective current distribution along the length of conductor 12 of antenna 10 is shown in FIG. 1B. Two shortened out of phase half wavelength sections 32 and 33 correspond to the locations of phasing apparatus 26 and 30, respectively. Two shortened out of phase half wavelength sections 34 and 35 correspond to the locations of phasing apparatus 18 and 22, respectively. The locations of the centers of the shortened out of phase half wavelength current sections correspond to the locations of the gaps in the corresponding phasing apparatus along conductor 12. For optimum performance, each phasing apparatus is located within its corresponding shortened out of phase current distribution along conductor 12. The feed point 13 corresponds to the maximum of an inphase current section 36. Half wavelength sections of inphase current distributions 37, 38, and 39 exist between phasing apparatus 18 and 22 on conductor 12*a*, phasing apparatus 26 and 30 along conductor 12*b*, and phasing apparatus 30 and end point 15 along conductor 12*b*, respectively. An inphase three tenths of a wavelength current distribution 40 also exists between ground plane 11 and phasing apparatus 18 and has a current maximum occurring at end point 14.

The distance between ground plane 11 and central feed point 13, for the 900Mhz antenna shown in FIG. 1A, is approximately 18 inches and the distance between end point 15 and ground plane 11 is approximately 39 inches in one practical case. By feeding antenna 10 at the central feed point 13, two separate radiating currents $I_1$ and $I_2$ are created on conductor 12, each of which will effectively travel approximately 20 inches away from point 13. If a similar 39 inch 900Mhz antenna were end fed, a single radiating antenna current would effectively travel 39 inches and the result would be a much narrower bandwidth for an antenna having a similar current distribution. It is known in the art that as the physical length of an electrical element (such as an antenna) is decreased, the bandwidth of the element (measured at a fixed center frequency) will increase. Thus by centrally feeding a gain antenna, an increase in the bandwidth has been obtained since each effective radiating current now only has to travel approximately half as far.

The same basic principle is applied to the inventive phasing apparatus which is used to produce an effective reactance at a point along the radiating conductor. By realizing an effective series inductance with a pair of opposing cylinders (such as 16 and 17) instead of a single long cylinder, a wide bandwidth effective inductance is obtained.

The amount of actual inductance contributed by each of the cylinders 16 and 17 at their open ends (effectively at point 19) was found to depend primarily upon the change in diameter between conductor 12*a* and the cylinders and their length along conductor 12*a*. Therefore making the phasing cylinders (sleeves) larger than the conductor, does not restrict the value of the inductance obtainable and permits minimizing the length of the cylinders. Since the diameter of the radiating conductor is not reduced by the inventive phasing apparatus, the mechanical strength of the antenna has not been degraded. Thus by using pairs of cylinders having larger diameters than the conductor 12*a*, phasing sleeves which produce a wide bandwidth reactance, are not limited in realizable reactance values by the diameter of the radiating conductor (12*a*) and do not weaken the mechanical strength of the resultant antenna structure have been provided. These sleeves can be easily positioned at any desired locations along the radiating central conductor 12 depending upon the operating frequency and current distribution desired.

Figure 2:
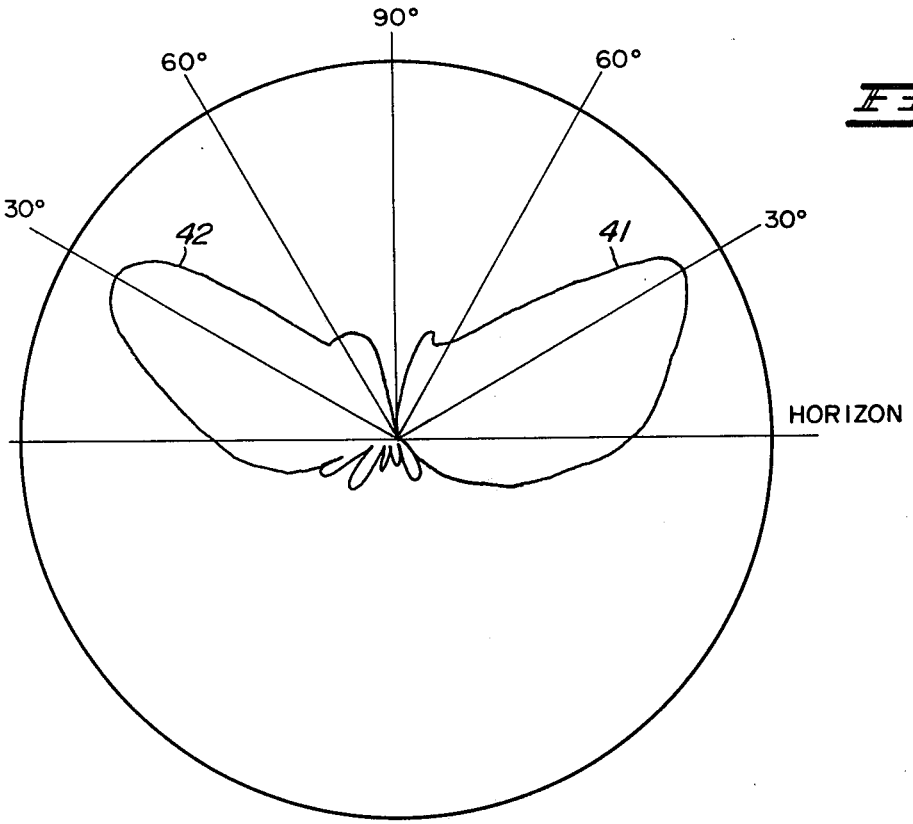
FIG. 2 is a graph illustrating the radiation pattern of a standard vertical quarter wavelength antenna.

Referring to FIG. 2, the radiation pattern of a standard quarter wavelength antenna perpendicularly mounted to a horizontal ground plane is shown. The radiation pattern is plotted for a vertical plane perpendicular to the horizontal ground plane and containing the quarter wavelength antenna. The radiation pattern consists primarily of two relatively wide oppositely directed lobes 41 and 42, each of which is centered approximately 30° above the horizon.

Figure 3:
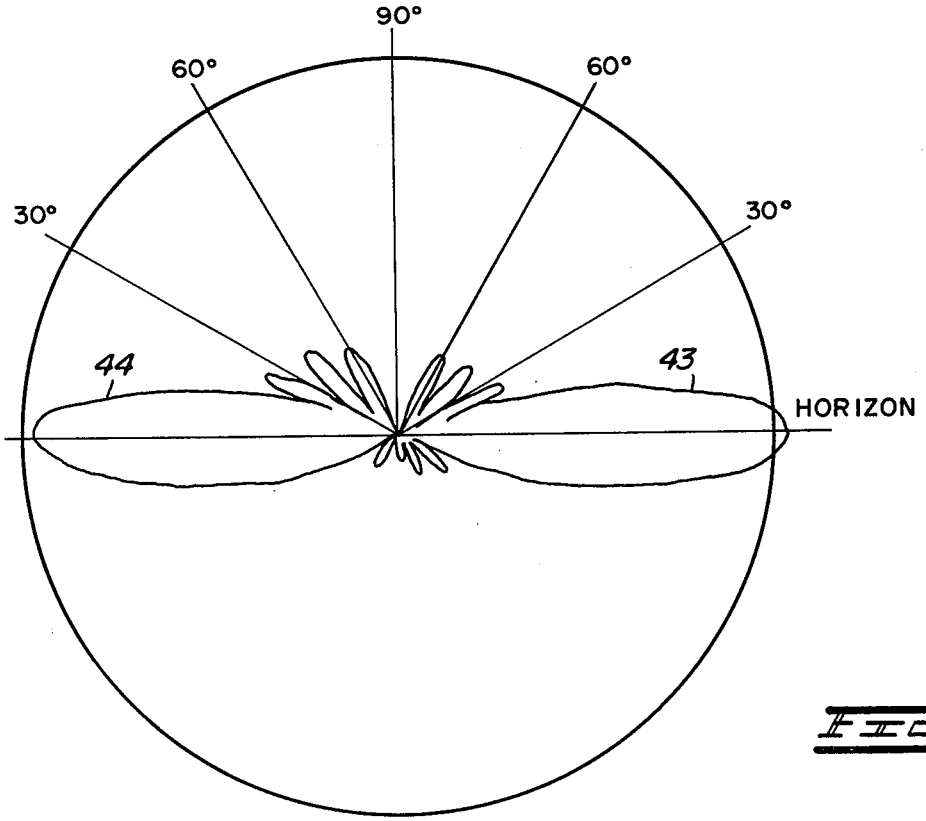
FIG. 3 is a graph illustrating the radiation pattern of the improved gain antenna.

Referring to FIG. 3, a similar radiation pattern is illustrated for the gain antenna of FIG. 1. Here the majority of the radiated power is again concentrated in two oppositely generated lobes 43 and 44, but the lobes are now centered in the direction of the horizon and are much narrower. Consequently, the gain of the antenna in FIG. 1 is much greater in the direction of the horizon. For the 900 Mhz antenna according to the invention, over 8db of gain was measured in the direction of the horizon as compared to the standard quarter wave antenna.

Figure 4:
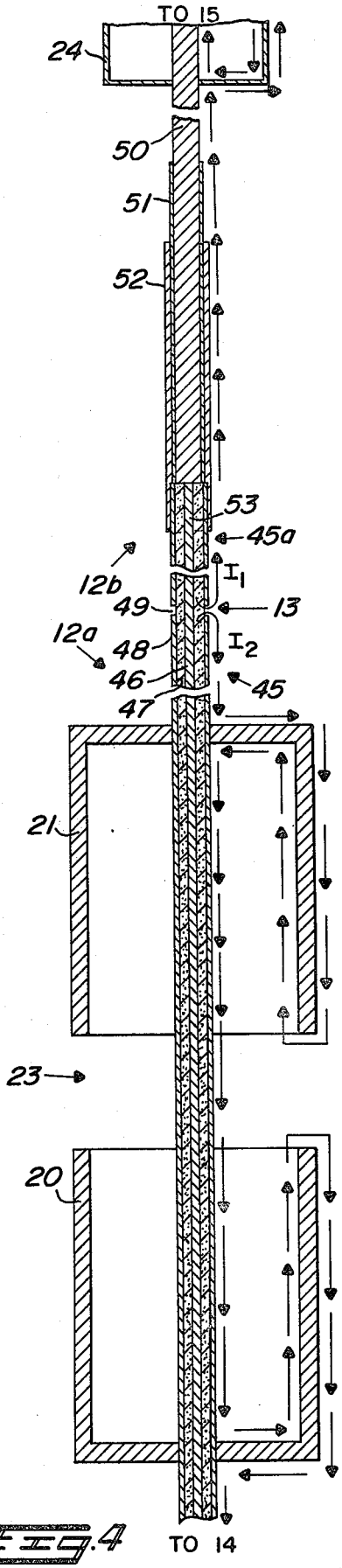
FIG. 4 is a fragmentary vertical cross-sectional view, on a larger scale, of the central area of the gain antenna shown in FIG. 1.

Referring to FIG. 4, an enlarged fragmentary vertical cross-sectional view of antenna 10 shows the lower conductor portion 12*a* as consisting primarily of a shielded coaxial cable generally referred to as 45 comprising a center conductor 46, a concentrically disposed dielectric medium 47 and an outer conductor 48. In a preferred embodiment, the coaxial cable 45 is similar to RG142 with the dielectric material 47 being teflon and the outer conductor 48 being a solid metallic sheathing instead of a metallic braid.

The coaxial cable 45, which comprises conductor portion 12*a*, extends beyond central feed point 13, the feed point being created by a sixteenth of an inch gap 49 occurring in the outer conductor 48 at point 13. The gap 49 should be a very small fraction of a wavelength, typically less than one hundreth. Approximately one inch above gap 49, coaxial cable 45 ends and a solid metallic rod 50 is connected thereto, the rod 50 continuing to extend outwardly to point 15. Rod 50 has a smaller diameter than coaxial cable 45 which results in smaller diameters for cylinders 24, 25, 28 and 29 as compared to the diameters of cylinders 16, 17, 20 and 21. This result occurs because the reactance produced by the cylinders depends primarily on the relative change in diameter between the radiating conductor and the phasing cylinder. Thus the portion of antenna 10 above feed point 13 is generally smaller than the portion below and this results in a more stable mechanical structure.

An inner metal support sleeve 51 surrounds conductor rod 50 and extends about an inch upward from the end of coaxial cable 45. An outer metallic sleeve 52 overlaps a portion of both coaxial cable 45 and inner support sleeve 51 and provides mechanical strength to the antenna structure as well as electrically connecting outer conductor 48 to solid rod 50.

The gap 49 is outer conductor 48 effectively creates a central feed point and feeds one current $I_1$ which travels up the outer surface of conductor 12*b* towards end point 15 and another current $I_2$ which travels over the outer surface of conductor 12*a* towards end point 14. A portion 45*a* of coazial cable 45 is shown extended beyond the central feed point 13 (gap 49) for impedance matching purposes. An extending portion 53 of the center conductor 46 effectively acts as a reactance which aids in matching the impedance of the antenna to a 50 Ohm source. By centrally feeding the gain antenna in this manner, an antenna input impedance level close to 50 Ohms can be obtained. This is far superior to the impedance level obtainable by standard end feeding techniques.

Figure 5:
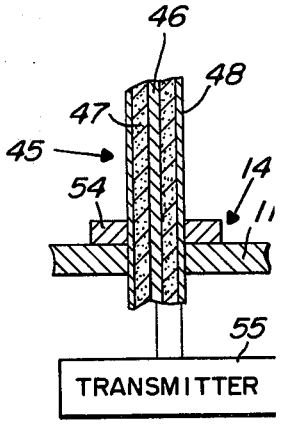
FIG. 5 is a cross-sectional view, on a still larger scale, of the connection between the antenna and ground.

Referring to FIG. 5, the connection between conductor 12*a* and ground plane 11 is shown more fully. Coaxial cable 45 passes through the non-radiating horizontal ground plane 11 and a metallic coupling ring 54 surrounds outer conductor 48, electrically and mechanically connecting the outer conductor to ground plane 11. Below ground plane 11, a transmitter 55 is shown connected to center conductor 46 and outer conductor 48. The transmitter 55 supplies an RF potential to cable 45 which results in antenna 10 being center fed with an RF potential at center feed point 13 (gap 49). In receiver applications, of course transmitter 55 would be replaced by a receiver.

In one particular 900Mhz vertical gain antenna constructed according to the present invention, the following dimensions were found to be satisfactory and to produce the current distribution shown in FIG. 1B. These dimensions are only exemplary and do not limit the scope of the invention.

| | | |
|---|---|---|
| Total antenna length (14 to 15) | | 39.125" |
| Center feed location (14 to 13) | | 17.875" |
| Center feed gap dimension (49) | | 1/16" |
| Coaxial cable outer diameter (45) | | .142" |
| Solid rod diameter (50) | | .095" |
| Phasing cylinders (16, 17, 20, 21) | O.D. | .925" |
| | I.D. | .797" |
| Phasing cylinders (24, 25, 28, 29) | O.D. | .625" |
| | I.D. | .595" |
| Phasing apparatus gaps 19 | | .37" |
| 23 | | 7/16" |
| 27 | | 1/8" |
| 31 | | 3/16" |
| Phasing apparatus location (above ground plane 11) | | |
| 18 | | 3.25"–6.0" |
| 22 | | 12.67"–15.44" |
| 26 | | 20.5"–23.25" |
| 30 | | 29.75"–32.5" |

While a specific structure for center feeding a gain antenna is herein described, the invention is not limited to the manner in which the gain antenna is center fed or the specific structures used for implementing the out of phase current sections along the radiating conductor length.

While I have shown and described specific embodiments of this invention, further modifications and improvements will occur to those skilled in the art. All such modifications which retain the basic underlying principles disclosed and claimed herein are within the scope of this invention.

I claim:

1. An improved gain antenna for use with a ground plane at predetermined frequencies, comprising:

conductor means having a predetermined length for radiating an electrical signal therealong, said conductor means having first and second ends spaced apart and a feed point located substantially centrally thereof, means located adjacent to said first end for positioning said first end adjacent to said ground plane and electrically connecting said first end to said ground plane, said second end being adapted to be positioned substantially away from said ground plane, and at least one phasing means coupled to said conductor means for producing along the length of said conductor means a predetermined current distribution having a shortened out of phase section and a current maximum occurring at the connection between the ground plane and said first end.

2. The gain antenna according to claim 1, which includes a plurality of said phasing means for producing a plurality of corresponding shortened out of phase current sections in said current distribution.

3. The gain antenna according to claim 2 wherein said conductor means extends substantially in a single linear direction.

4. The gain antenna according to claim 3 wherein said conductor means is adapted for extending substantially perpendicularly from said ground plane.

5. The gain antenna according to claim 4 wherein said phasing means are positioned on both sides of said central feed point.

6. The gain antenna according to claim 5 wherein said conductor means from said center feed point to said second end substantially comprises a single solid rod.

7. The gain antenna according to claim 6 wherein said conductor means from said center feed point to said first end substantially comprises a coaxial cable having a center conductor, an outer conductor, and a dielectric located between said outer and center conductors.

8. The gain antenna according to claim 7 wherein said coaxial cable has a portion extending beyond said central feed point and said outer conductor has a gap therein at said central feed point, said extended portion of said coaxial cable having its center and outer conductors electrically connected to said rod, said gap comprising said central feed point.

9. The gain antenna according to claim 8 wherein each of said phasing means comprise a pair of metallic cylinders concentrically coupled to said conductor means.

10. The gain antenna according to claim 9 wherein each of said cylinders of each pair has an open end positioned adjacent to one another and a closed end electrically and mechanically connected to said conductor means.

11. The gain antenna according to claim 10 wherein said plurality of phasing means consists of 8 cylinders arranged in four pairs.

12. The gain antenna according to claim 10 wherein the distances from said first and second ends of said conductor means to said central feed point are each substantially greater than a half wavelength at said predetermined frequencies.

13. The gain antenna according to claim 10 wherein said solid conductor rod has a diameter less than the diameter of said coaxial cable.

14. Phasing apparatus for producing a wide bandwidth reactance on a straight section of an antenna at predetermined frequencies, comprising:

a straight section of conductor means for radiating a signal, said conductor means having a predetermined diameter, first and second metallic cylindrical sleeves adapted to be concentrically positioned about said straight conductor section and each having a predetermined diameter larger than said conductor means diameter, each of said cylindrical sleeves having an open end and a closed end, the distance between the open and closed ends of each sleeve being substantially less than a quarter of a wavelength at said predetermined frequencies, said open ends being positioned facing and adjacent to one another, said closed ends being electrically and mechanically connected to said conductor section, whereby each of said sleeves contributes a reactance to said conductor means at its open end.

15. An improved gain antenna for use with a ground plane at predetermined frequencies, comprising:

conductor means having a predetermined length for radiating an electrical signal therealong;

said conductor means having a substantially predetermined diameter, first and second ends spaced apart, and a feed point located substantially centrally thereof;

said first end being adapted to be positioned adjacent and electrically coupled to said ground plane;

said second end being adapted to be positioned substantially away from said ground plane; and at least one phasing means coupled to said conductor means for producing along the length of said conductor means a predetermined current distribution having a shortened out of phase section;

said phasing means comprising a pair of cylinders consisting of first and second metallic cylindrical sleeves adapted to be concentrically positioned about said conductor means and each having a predetermined diameter larger than said conductor means diameter;

each of said cylindrical sleeves having an open end and a closed end;

said open ends being positioned facing and adjacent to one another;

said closed ends being electrically and mechanically connected to said conductor means.

16. The gain antenna according to claim 15 which includes a plurality of said phasing means cylinder pairs for producing a plurality of corresponding shortened out of phase current sections in said current distribution along said conductor means, the distance between the open and closed ends of each of said sleeves in each of said cylinder pairs being substantially less than a quarter of a wavelength at said predetermined frequencies.

17. The gain antenna according to claim 16 wherein each of said phasing means is located within its corresponding shortened out of phase current distribution along said conductor means.

* * * * *